United States Patent [19]

Charbonneau

[11] Patent Number: 4,889,755

[45] Date of Patent: Dec. 26, 1989

[54] FRAGRANCE RELEASING PULL-OUT SAMPLER

[75] Inventor: Jack W. Charbonneau, Somerset, Wis.

[73] Assignee: Minnesota Mining and Manufacturing Company, St. Paul, Minn.

[21] Appl. No.: 265,710

[22] Filed: Nov. 1, 1988

[51] Int. Cl.[4] ..... B32B 7/06; B32B 7/12

[52] U.S. Cl. ..... 428/42; 428/43; 428/68; 428/321.5; 428/905; 239/34

[58] Field of Search ..... 428/42, 68, 321.5, 905, 428/43, 40; 239/34

[56] References Cited

U.S. PATENT DOCUMENTS

| | | | |
|---|---|---|---|
| 2,717,174 | 9/1955 | Casanovas | 428/905 |
| 4,237,591 | 12/1980 | Ginocchio | 28/121 |
| 4,487,801 | 12/1984 | Turnbull et al. | 428/313.5 |
| 4,720,417 | 1/1988 | Sweeny et al. | 428/201 |
| 4,720,423 | 1/1988 | Fraser | 428/905 |
| 4,752,496 | 6/1988 | Fellow et al. | 428/905 |

*Primary Examiner*—Alexander S. Thomas

*Attorney, Agent, or Firm*—Donald M. Sell; Walter N. Kirn; Mark A. Litman

[57] ABSTRACT

Encapsulated liquids may be provided as samples by binding a removable strip between two cover sheets. The strip is adhesively secured on at least one face to the inside of the cover sheets by an adhesive bearing the microencapsulated liquid.

20 Claims, 1 Drawing Sheet

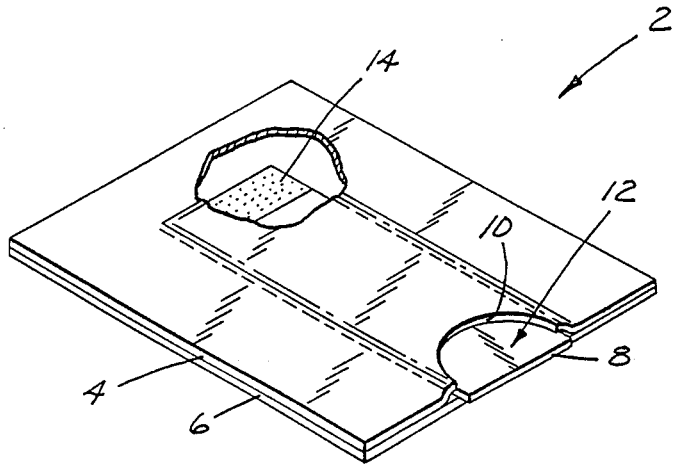
2
14
12
10
8
4
6

FRAGRANCE RELEASING PULL-OUT SAMPLER

FIELD OF THE INVENTION

This invention relates to microencapsulated materials and sampler articles containing microencapsulated materials. In particular the present invention relates to microencapsulated materials on a strip provided between two sheet surfaces such that upon removal of said strip from between said two surfaces, some capsules rupture, releasing material contained therein.

BACKGROUND OF THE INVENTION

Encapsulated materials have been used for many years in a wide variety of commercial applications. Early uses of encapsulated materials included paper coated with capsules bearing coloring material therein which could be used as a recording medium. U.S. Pat. No. 3,016,308 discloses one of the early efforts using encapsulated material as the image source on recording paper. U.S. Pat. Nos. 4,058,434 and 4,201,404 show other methods of application of encapsulated coloring materials on paper substrates to be used as imaging media and the like. U.S. Pat. No. 3,503,783 shows microcapsules having coloring material therein which are rupturable by the application of heat, pressure and/or radiation because of a metal coating on the surface of the capsule. These rupturable microcapsules, in one embodiment, may be secured between a substrate and a photoconductive top coat to enable photosensitive imaging of the system.

A wide variety of processes exist by which microcapsules can be manufactured. These varied processes provide different techniques for producing capsules of varying sizes, alternative materials for the composition of the capsule shell and various different functional materials within the shell. Some of these various processes are shown in U.S. Pat. Nos. 3,516,846; 3,516,941; 3,778,383; 4,087,376; 4,089,802; 4,100,103 and 4,251,386 and British Patent specification Nos. 1,156,725; 2,041,319 and 2,048,206. A wide variety of different materials may also be used in making the capsule shells. A popular material for shell formation is the polymerization reaction product between urea and formaldehyde or melamine and formaldehyde, or the polycondensation products of monomeric or low molecular weight polymers of dimethylolurea or methylolated urea with aldehydes. A variety of capsule forming materials are disclosed, for example, in U.S. Pat. Nos. 3,516,846 and 4,087,376 and U.K. Patent Specification Nos. 2,006,709 and 2,062,570.

As shown in these references, the principal utility of microencapsulated materials is in the formation of a surface coated with the microcapsules in a binder. The microcapsules are ruptured by various means to release the material contained therein. In addition to release of physically observable materials such as ink in order to form a visible image, other types of active ingredients such as odor releasing materials, bacteriostatic materials, chemically active materials and the like have been provided in this manner.

U.S. Pat. No. 4,186,743 describes the use of microcapsules on a pressure sensitive adhesive between two surfaces on a sanitary napkin. When a cover layer is removed, capsules are broken and the fragrance is released.

U.S. Pat. No. 4,487,801 describes the use of a non-pressure sensitive adhesive layer between two surfaces, the layer having fragrance containing microcapsules therein. Upon separation of the two surfaces, the adhesive and the microcapsules are ruptured, releasing the fragrance. U.S. Pat. No. 4,720,417 shows a similar article in which the two surfaces are coated paper surfaces.

SUMMARY OF THE INVENTION

A fragrance sampler is provided with at least one removable strip bearing samples thereon. The sampler comprises two sheets with an opening between them. Within the opening is a strip which is severably adhesively secured to at least one inner surface of at least one of said sheets. At least a portion of the adhesive (but not necessarily all of the adhesive) contains rupturable microcapsules which contain fragrant materials to be sampled. Pulling the strip from between the sheets ruptures the adhesive and some of the capsules therein by shearing forces. The strip is removed from the sheets, exposing the fragrance released, and allowing further fragrance release by breaking capsules remaining unbroken on the strip after removal.

BRIEF DESCRIPTION OF DRAWING

The FIGURE shows a perspective of a fragrance sampler of the present invention.

DETAILED DESCRIPTION OF DRAWING

The FIGURE shows a fragrance sampling device 2 which has a top sheet 4 and a bottom sheet 6 which sandwiches a sampling strip 12. The sampling strip 12 resides between the two sheets 4 and 6 and is shown to be adhered to at least one sheet by a patch of adhesive 14 which contains fragrance-bearing microcapsules (not shown). A portion 8 of the sampling strip 12 is exposed to allow a user to grasp that portion 8 and remove the strip 12 from between the two sheets 4 and 6. The force of pulling said strip 12 from the sampling device 2 ruptures the adhesive patch 14 and releases fragrance in the microcapsules (not shown) by contemporaneous rupturing of the capsules. A cut 10 may be provided in one or more of the sheets 4 and 6 to expose a portion 8 of said sampling strip 12. Perforations (not shown) may alternatively be provided in one or both of said sheets 4 and 6 to allow removal of said sampling strip 12.

DETAILED DESCRIPTION OF THE INVENTION

The present invention relates to a fragrance sampling device in which the fragrance is carried at least in part on a removable strip. The removable strip is carried between two opposed surfaces which may be two separate sheets secured at their opposed edges or opposed faces of a folded single sheet temporarily secured by means of an adhesive coating on edges of each of the opposing faces of the sheets and a second adhesive layer having microcapsules dispersed therein. Generally flexible sheets of paper or premium papers are preferred, but sasheen, non-woven, woven or knit fabric (e.g., silk, cotton, or nylon) or paper, and polymeric film, natural or synthetic fiber, or cardboard may be used. Coated paper is preferred and is a conventional and standard item in commerce. It is generally a fibrous sheet having a pigment-bearing resinous coating on one or both surfaces. Usually the pigment provides a white, bone or ivory coloration to the sheet. Most generally pigments producing a white coloration are used. The binder used in the resinous coating is generally colorless and/or transparent. The binder is generally a synthetic or natural organic polymeric material. Typical pigments for producing white coated paper are fine white pigment such as clay, calcium carbonate, titania, silica, zinc oxide, etc. Typical binders include latices (e.g., styrene-butadiene, butadiene-acrylonitrile, etc.), film-forming polymers (e.g., polymethylmethacrylate), and natural resins (e.g., casein, ammonium caseinate, starch, etc.). The coatings usually comprise between 65–90% by weight of pigment, preferably 70–80% by weight of pigment, and 10–35% by weight of binder, preferably 20–30% by weight of binder. Papers having both sides coated are preferred in the advertising trade.

The properties of such paper coatings as are commonly encountered in commerce vary widely from one manufacturer to another and even from lot to lot. This has made it necessary to adjust the composition, coating weight, and coating conditions for each individual production run in order to obtain the best balance of peel force and capsule rupture in the products of the prior art. We have found in copending U.S. Ser. No. 211,870 filed June 27, 1988, that a base coating applied to the paper stock prior to the application of the capsule containing layer may greater reduce the variability previously encountered. The base coatings are believed to function, in part, by controlling the rate and degree to which the carrier liquid for the capsule containing layer penetrates the underlying paper. This in turn influences the effective amount and distribution of binder in the dried capsule containing layer and the resulting mechanical properties of the layer. It is preferably desirable to select the polymer employed to form the base coat layers from materials which will act as an adhesive for the capsules when wet by the carrier liquid used to apply the capsule containing layer.

In the event that the polymer of the base coat layers is not soluble in or softened by the carrier liquid for capsules, it is desirable to include a separate binder in the capsule containing layer. This binder may be employed at lower levels than those of the prior art capsule coating systems.

The adhesive material for the capsules must form a bond to the coated surfaces of the sheets which is stronger than the cohesive strength of the adhesive with the capsules dispersed therein. Although it is generally desirable to have an adhesive, the absolute cohesive strength of which is less than its adhesive strength to the surface of the paper cover sheets, this is not essential. When capsules are included within the adhesive composition, the effective cohesive strength of the adhesive tends to be reduced. Adhesives, which by themselves would cause the sheets to be damaged during separation, can be used in combination with capsules in the practice of the present invention because of lowered effective cohesive strength. The capsules in the present invention may comprise any rupturable capsule containing an active ingredient therein. The active ingredient may be a fragrance, medicinal liquid, one part of a two part reactive system, test indicator, repellent, or the like. The tensile rupture strength of the capsules must be such that the cohesive failure of the adhesive results in at least capsule breakage. It has also been found that the size of the capsules plays a role in the usefulness of capsules within rupturable sheets according to the practice of the present invention. Generally the capsules should have an average diameter between 6 and 500 microns and preferably between 12 and 30 microns when the capsule payload is between 80 and 90% by weight of the total capsule weight. It is highly preferred that the capsules have an average diameter between 14 and 60 microns and it is most preferred that the capsules have a diameter between 15 and 25 microns. These dimensions play a surprisingly important role in the ability to control the percentage of rupture of capsules in the practice of the present invention. With lower payloads (e.g., 70–80%), the capsules should be larger to provide the necessary rupture strength. The broadest range of average capsule size under most conditions would be about 4 to 200 microns. When 8 micron capsules are used, a 90–95% by weight payload is preferred. Eight to thirty micron capsules are generally preferred.

The capsules should form between 20 and 99 percent by volume of the total adhesive composition, and preferably between 90 and 98 percent of the total composition volume. If certain microcapsule shell materials are used, such as gelatin, the capsule may comprise as much as 100% of the adhesive compositions. The absolute peel force tends to be dependent on the weight of the base coat and relatively independent of the amount of capsules (up to 50% by weight of capsules per unit area).

The two opposed surfaces may be the same or different. There may be a first adhesive in said base coating composition and a said second adhesive may be present in the capsule composition, said second adhesive also may be the same or different material from said first adhesive. Both adhesives may be swellable, softenable, or soluble in the solvent of the adhesive composition. The solvent or carrier liquid also must not quickly dissolve the microcapsules (e.g., in less than one hour). The first adhesive dries to some extent before the capsule coating composition is applied and may be intentionally air dried or oven dried before the adhesive composition is applied.

The solvent may be water or organic solvents or mixtures thereof. The organic solvents may be polar or non-polar, depending upon the solvation requirements of the binders.

The bonding of the surfaces may be effected in a number of alternative fashions. The base coatings on both opposed faces of the sheets may be the sole adhesive coating compositions. This can be done by applying the microcapsule slurry composition between the opposed faces either (1) before complete drying of the base coat so that it can act as an adhesive without further solvent activation (some thermal activation may be desirable), or (2) after drying but with the microcapsule slurry coating composition containing a liquid carrier medium which is an activating solvent for the adhesive in the base coat, or (3) after drying but with the microcapsule slurry coating composition containing sufficient amounts of an adhesive which can bond the two adhesive (polymer) coated opposed faces together. The binder or adhesive should not be a pressure-sensitive adhesive as these tend to perform extremely inefficiently and poorly.

The areas of bonding between the opposed faces can be made discontinuous in a very easy procedural modification. By printing the base coat adhesive composition in a discontinuous manner and not using any significant amount of adhesive (e.g., a polymeric thickener may be used to increase the viscosity of the microcapsule slurry) in the microcapsule slurry coating composition, the opposed faces will be adhered only in those areas where the base coat adhesive has been printed. The slurry carrying medium is usually a solvent for the base coat adhesive in this embodiment. The microcapsules will lightly adhere to the faces of the sheet, but will not rupture upon separation of the opposed faces. This will allow for reuse of the fragrance; i.e., additional microcapsules can be ruptured by scratching after the sheets have been separated.

The binders may be water-soluble, aqueous-swellable, or organic solvent soluble. Preferred binders are at least water-softenable binders such as polyvinyl pyrrolidone, gelatin, polyvinyl alcohol, hydroxyethyl cellulose, hydroxypropyl cellulose, or may be organic solvent soluble polymers such as polyvinyl ethers, polyacrylates, polyamides, polyester, polyvinyl chloride, polyvinylidene chloride, polylyrene, and mixtures, blends, or copolymers of these types of materials.

It is particularly desirable in the present invention to use an amount of binder in the capsule layer coating composition which is too small to form an adhesive bridge between the two surfaces by itself. This would require the use of binders which are present at less than 10% by weight of the capsule weight, preferably less than 7% and most preferably less than5% and greater than 0.2%. Larger concentration of binder (e.g., 80%) can be used, but the preferred practice is as just described.

The microcapsule-bearing adhesive is coated onto the strip or onto a face of an interior surface of a sheet. The adhesive may be the sole bonding material between the strip and the sheets. It is also possible to precoat part or all of the strip with the fragrance-bearing microcapsule filled adhesive and use a separate adhesive to bond the strip into the space between the sheets. The separate (non-microcapsule-bearing) adhesive may overlap the microcapsule filled adhesive in part or completely or over a greater area. Some of the capsules will rupture when a second adhesive is used, the amount of the breakage depending upon such factors as interpenetration of the adhesives and solvents, relative rupture strength of the two adhesives, relative bond strength between the adhesives (as compared to bond strengths to the strip and the sheet), and the area covered by the adhesives and the thickness of the adhesives.

There may be one or more such strips between each pair of sheets. The vapor permeability of the sheets may be chosen to assist in preventing prematurely ruptured capsules (e.g., broken by physical handling or other external processing, packaging or transporting) from releasing the fragrance to the air. By providing sheets with permeabilities of less than 4.0 g vapor/$m^2$ per minute at 1.1 atmospheres, preferably less than 1.0 g/$m^2$, substantial reduction in objectionable and spurious fragrance release can be provided.

The present invention provides sampling devices for liquids having (1) two opposed faces of two sheets forming an enclosed area, (2) a strip within said enclosed area, (3) said strip having on at least one face thereof an adhesive bearing microcapsules, said microcapsules containing a liquid therein, (4) said strip being adhesively secured to at least one of said two opposed faces.

It is preferred that said microcapsules have an average diameter between 4 and 500 micrometers, the cohesive strength of the adhesive composition layer being less than the strength of the bond between said adhesive composition and a coated face of said sheets, the tensile rupture strength of said microcapsules being less than the cohesive strength of the adhesive composition, and the rupture force of said microcapsule containing adhesive composition layer at 50% relative humidity being between at least 0.5 ounces per linear five-and-one-half inches and less than 10 ounces per linear five-and-one-half inches (greater than 1.0 g/cm and less than 20 g/cm). It is preferred that the rupture strength between the sheets exceeds 2.0 g/cm and is less than 16 g/cm and most preferably exceeds 2.5 g/cm and is less than 10 g/cm. The minimum strength at this ambient condition (i.e., 23° C. and 50% R.H.) is necessary to keep the sheets from falling apart from forces incurred during handling. This problem has frequently occurred in magazine inserts where coated paper has been used. The maximum limit on the rupture strength is necessary to keep the paper from tearing (termed fiber pull or fiber rupture) before the adhesive and capsules rupture. This would prevent release of the liquid from the capsules. These peel forces are described in terms of the peel forces measured by pulling the top sheet (the strip) when it is folded back away from the base sheet so that a 180° peel force is measured. In actual use, the adhesive is ruptured by shear forces provided from pulling the sampler strip. The peel force is a conventionally measured property and has been found in the practice of the present invention to be related to the shear force so that measurement of the peel force accurately preducts the shear forces. The shear forces used in the present invention tend to require one-fourth the peel forces needed in pull-apart sheets like those disclosed in U.S. Pat. Nos. 4,487,801 and 4,720,417. The present construction also helps prevent premature separation since the strip is sandwiched between two protective sheets.

It is also desirable to have the construction resist the effects of variable ambient conditions. Certain products presently used on uncoated paper stock work in ambient conditions but fail in transit or on storage as the temperature and humidity change. Given the fact that some of these compositions fail at even standard conditions (23° C. and 50% R.H.), they tend to fail more readily at more extreme conditions such as 26.5° C. and 80% R.H. or in dry conditions. For example, some binders or capsules are dehydrated by storage in heated warehouses during the winter and become so fragile that simple handling will rupture them. Complaints have been made by purchasers of magazines that all of the various odors in inserts are being released prior to usage of the magazine. The entire magazine tends to have a strong composite odor of many scents rather than being able to provide distinct samples of individual scents. It is therefore desirable that rupture strength exceed 0.5 g/cm after storage at 49° C. and less than 10% R.H. for seventy-two hours. This test may be performed by storage in an oven, removal to a neutral environment (e.g., sealed bag or jar) until the article is at room temperature, and then measuring the rupture strength. It is preferred that the rupture strength is at least 1.0 to 2.0 g/cm and most preferred that the rupture strength is at least 2.5 g/cm under those conditions. The article must still display a rupture strength between 0.5 and 20 g/cm at 23° C. and 50% R.H.

A number of methods have been found which enable these conditions to be met. The use of viscosity increasing agents in the capsule containing coating composition provides a more even coating and one that ruptures before fiber pull begins. The use of additional coatings over the coated paper which contain polymers different from the binder of the adhesive layer and which do not form a solution or chemically bond to the binder of the adhesive layer provides a useful article according to the present invention. The use of larger size capsules tends to weaken the cohesive strength of the adhesive composite and prevent fiber pull. The use of capsules which are not moisture sensitive in combination with these large capsules (i.e., greater than 30 microns and up to 500 microns) provides a useful adhesive layer. Higher capsule-to-binder ratios reduce the cohesive strength of the adhesive, as may the addition of non-viscosity enhancing particulate fillers. The viscosity increasing agents described in U.S. Pat. No. 4,720,417 have been found to be useful in the coatings of this invention.

The inorganic particles tend to be preferred. The viscosity enhancers have been found to be necessary in dry weight proportions of the adhesive mix in amounts of from 0.25 to 12% by weight, preferably from 5 to 12% by weight. In general, the weight proportions of materials in the dried adhesive layer according to the present invention are generally as follows:

Microcapsules: 80%–100%

Adhesive: 20%–0%

Viscosity Enhancers: 0.0–10%

The slurry composition may vary from 98% capsules and 2% non-capsule solids to 10% capsules and 90% non-capsule solids with 0–50% binder present in the non-capsule solids. A typical formulation would be 10–50% capsules, 0.1 to 2% viscofier and 48–89.9% water.

The ability to use coated paper in the manufacture of these articles is important because that material is the standard printing medium of the trade. Those papers enable the highest quality printings to be made in combination with the releasable materials of the present invention.

The nature and composition of the adhesive binder is not critical to the practice of the invention as long as the required functional, adhesive and cohesive properties are met. The adhesive may be pressure sensitive, water or solvent borne or thermally activatable. A single layer of a non-pressure-sensitive adhesive is preferred. There is no need for rejoining the sheets after rupturing of the capsules and so the pressure sensitive function is not necessary.

The base coat layer and the adhesive (with microcapsules) may be applied between two separate sheets in either a continuous or discontinuous patterns. It is usually desirable to leave at least some portion of at least one outer edge of the sheets unbonded so as to provide an area where separation and removal of the strip can be easily started. A single sheet may be folded so as to form two facing sheets joined along one edge. The adhesive may be applied on the interior area adjacent to the fold.

It is preferred that the capsule-bearing adhesive coated portion of the strip constitute from 5 to 100% of the surface area of the sheets. In preferred constructions, 10 to 95 percent adhesive coverage is used, the 95% limit providing a gripping area free of the liquid.

Any class of adhesives, including but not limited to polyurethanes, polyacrylates, polyvinyl resins (e.g., polyvinyl alcohol, polyvinyl chloride), polyamides, polyesters, polyolefins, starches, gum arabic, gelatin and the like may be readily used in the practice of the present invention. These materials may be applied from either water or organic solvents depending on the solubility of the individual materials. Washing of the capsules before coating them over the base coat adhesive tends to provide more consistency in their properties by removing low molecular weight, unreacted materials.

In effect, to best practice the present invention it is desirable that certain properties within the article have relative values for each of the materials used. The cohesive strength of the sheet material should exceed the adhesive shear strength between the base coat binder, the sheet, and the strip. The adhesive strength of the base coat binder to the sheet should exceed the cohesive strength of the binder. The cohesive strength of the base coat layer and any binder present in the capsule layer should exceed the tensile rupture limits of the capsules.

As previously noted, the size of the capsules has an important effect upon the practice of the present invention. With capsules less than 8 microns, there tends to be less rupturing of the capsules so as to prevent the useful and efficient release of materials. Above 100 microns, the particles are so large that additional care is necessary in handling of the sheets and manufacturing procedures. Furthermore, with the large size particles it is extremely difficult to control bursting upon separation of the sheets because of increased effects upon adhesive and cohesive properties of materials in contact with the capsules. The preferred ranges of 8 to 70 and 25 to 60 microns is important to the practice of the present invention. Within these limits, rupture in excess of 50 percent of the capsules can be easily obtained. Rupture in excess of 80 percent of the capsules in contact with the base coat can often be accomplished in the practice of the present invention within those limits.

The capsules may contain a wide variety of active materials therein. The least useful of materials to be included therein would be coloring agents since separation of the sheets would generally produce uniform coloration rather than a distinct image. The most preferred types of ingredients would be fragrant materials (such as essences and perfumes) or materials which provide chemically active vapors or liquids (e.g., bacteriostats or deodorants) to be wiped on or transferred to another surface. These may or may not also be colored. For example, a testing kit for the presence of chemical vapors could be produced by providing material within the capsules which would react with the vapor phase material for which a leak is being investigated. By removing the sampler strip, rupturing the capsules and exposing the vapor test material, a color forming reaction with the air or on the sheet could be readily observable. The sides of the sheets with the capsule-bearing adhesive thereon are preferably printed under the adhesive or adjacent the adhesive.

These and other aspects of the present invention will be shown in the following examples.

EXAMPLE I

An oil having the aroma of roses was encapsulated in a urea-formaldehyde resin made according to the process of Example 20 of U.S. Pat. No. 3,516,941. The capsules had an average diameter of about 25 micrometers and an estimated payload of 85% by weight (ratio of oil to total capsule weight).

The following coating formulations were then prepared.

| Base Coat | gms |
|---|---|
| Airvol 205 (polyvinyl alcohol) | 200.00 |
| $H_2O$ | 1133.33 |

-continued

| Base Coat | gms |
|---|---|
| Syloid 244 (thickener) | 17.39 |

The polyvinyl alcohol was dispersed in the water and then heated to 180° F. (79° C.) for 30 minutes to dissolve the PVA. The mixture was then cooled to room temperature and the thickener was mixed in.

| Capsule Slurry | Dry | Wet |
|---|---|---|
| 98.3% capsules | 1000.00 | 2500.00 |
| 1.7% Klucel TM HF (hydroxy methyl cellulose ester polymer) | 17.29 | 864.50 |
| | 1017.20 | 3364.50 |

The new format was produced in the following manner on an M-100 heat set web off-set printing press equipped with ribbon splitting capability. The Base Coat was applied at 0.20 lbs./1300 $ft^2$ (8.3 $g/m^2$) coating weight in front of the first oven. The same oven used for drying the inks. The base coat was applied at 0.25 inch (0.64 cm) width to only the ribbon portion of the format. The Slurry was applied over the dry base coat stripe at a 3.0 lbs./1300 $ft^2$ (125 $g/m^2$) coating weight and at a 0.5 inch (1.27 cm) wide stripe. The ribbons were then slit and layered in position such that, when the unit was folded, the new format was obtained.

1. 70 lbs. (31.8 kg) C2S Base Stock or alternate web off-set base stock.

2. Fragrance Burst Slurry coated at 0.5 inch (1.27 cm) wide stripe, at 3.0 lbs./1300 $ft^2$ (125 $g/m^2$) coating weight. Stripe width and coating weight may be modified to obtain desired fragrance level.

3. Base Coat coated at 0.25 inch (0.64 cm) wide stripe and 0.20 lbs./1300 $ft^2$ (8.3 $g/m^2$) coating weight. Stripe width and coating weight may be modified to obtain desired mechanical bond strength and fragrance level. Note that only half of the fragrance stripe is coated over the base coat stripe. This allows for complete removal of the unbonded fragrance stripe when sampled on the skin.

4. Needle Glue was used to form pockets that hold ribbons.

5. Die cuts on the cover sheet allow easy access to ribbons for removal of ribbon.

We claim:

1. A sampling device for liquid materials comprising
(a) two sheets which form an enclosed area,
(b) a removable strip is present at least in part within said enclosed area,
(c) said strip has on at least some portion of at least one surface thereof microcapsules and a binder material, said microcapsules containing a liquid therein,
(d) said strip is adhesively secured to at least one sheet within said enclosed area.

2. The device of claim 1 wherein said strip is adhesively secured to said at least one sheet at least in part by an adhesive containing microcapsules which contain liquid therein.

3. The device of claim 2 wherein said liquid comprises a volatile fragrance.

4. The device of claim 1 wherein said strip is adhesively secured to said at least one sheet only by an adhesive containing microcapsules which contain liquid therein.

5. The device of claim 4 wherein said liquid comprises a volatile fragrance.

6. The device of claim 1 wherein said strip is both adhesively secured to said at least one sheet and is secured by a perforated area on said at least one sheet.

7. The device of claim 6 wherein said binder with said microcapsule is present as less than 7% by weight of said microcapsules.

8. The device of claim 7 wherein said liquid comprises a volatile fragrance.

9. The device of claim 6 wherein at least one of said sheets is two-side coated paper.

10. The device of claim 6 wherein said liquid comprises a volatile fragrance.

11. The device of claim 1 wherein said binder with said microcapsules is present as less than 10% by weight of said microcapsules.

12. The device of claim 11 wherein said liquid comprises a volatile fragrance.

13. The device of claim 1 wherein a second binder is present on said strip to bond said strip to said at least one sheet.

14. The device of claim 13 wherein said second binder is the same material as said binder in said binder and microcapsule.

15. The device of claim 13 wherein said second binder is a different material from said binder in said binder and microcapsule.

16. The device of claim 1 wherein at least one of said sheets is two-side coated paper.

17. The device of claim 1 wherein said liquid comprises a volatile fragrance.

18. The device of claim 17 wherein said two sheets are not readily permeable to the vapors of said liquid.

19. The device of claim 1 wherein said two sheets are not readily permeable to the vapors of said liquid.

20. The device of claim 19 wherein said permeability is less than 1.0 $g/m^2$ vapor/minute at 1.1 atmospheres.

* * * * *